US008461439B2

(12) United States Patent
Rashleigh

(10) Patent No.: US 8,461,439 B2
(45) Date of Patent: Jun. 11, 2013

(54) MUSICAL INSTRUMENTS

(75) Inventor: Hugh Michael Rashleigh, Coventry (GB)

(73) Assignee: Rashleigh Ltd (GB)

( * ) Notice: Subject to any disclaimer, the term of this patent is extended or adjusted under 35 U.S.C. 154(b) by 21 days.

(21) Appl. No.: 13/263,780

(22) PCT Filed: Apr. 19, 2010

(86) PCT No.: PCT/GB2010/000782

§ 371 (c)(1), (2), (4) Date: Oct. 10, 2011

(87) PCT Pub. No.: WO2010/122289

PCT Pub. Date: Oct. 28, 2010

(65) Prior Publication Data

US 2012/0024127 A1 Feb. 2, 2012

(30) Foreign Application Priority Data

Apr. 23, 2009 (GB) ..... 0906968.3

(51) Int. Cl.
*G10D 7/10* (2006.01)

(52) U.S. Cl.
USPC ..... 84/395; 84/387 R

(58) Field of Classification Search
USPC ..... 84/394, 387 R
See application file for complete search history.

(56) References Cited

U.S. PATENT DOCUMENTS

| | | | | | |
|---|---|---|---|---|---|
| 1,763,336 | A * | 6/1930 | Wilder | 84/387 R |
| 2,373,110 | A | 4/1945 | Forssberg | |
| 2,574,591 | A * | 11/1951 | Rudd | 84/723 |
| 2,730,002 | A * | 1/1956 | Edward | 84/375 |
| 3,474,698 | A * | 10/1969 | Seisai | 84/399 |
| 3,482,026 | A * | 12/1969 | Babicky | 84/723 |
| 3,507,181 | A * | 4/1970 | Cardwell, Jr. | 84/388 |
| 3,593,145 | A * | 7/1971 | Valley | 455/91 |
| 3,808,935 | A * | 5/1974 | Reeves | 84/399 |
| 4,273,020 | A * | 6/1981 | Happe | 84/394 |
| 4,395,933 | A * | 8/1983 | Shepley | 84/399 |
| 4,860,629 | A * | 8/1989 | Del Giudice | 84/395 |
| 4,997,402 | A | 3/1991 | Blease | |
| 7,078,605 | B2 * | 7/2006 | Love | 84/398 |
| 7,097,533 | B2 * | 8/2006 | Szekely | 446/213 |
| 7,179,977 | B1 * | 2/2007 | Kelly | 84/398 |
| 7,560,631 | B1 * | 7/2009 | John et al. | 84/398 |
| 7,705,227 | B2 * | 4/2010 | Hamanaga | 84/387 R |
| 8,324,491 | B1 * | 12/2012 | Malluck | 84/387 R |
| 2008/0202314 | A1 * | 8/2008 | Thanyakij | 84/385 R |
| 2012/0024127 | A1 * | 2/2012 | Rashleigh | 84/396 |

FOREIGN PATENT DOCUMENTS

FR 2718271 A1 10/1995

OTHER PUBLICATIONS

UKIPO Search Report for priority GB application (GB 0906968.3) of PCT/GB2010/000782.

(Continued)

*Primary Examiner* — David Warren
*Assistant Examiner* — Robert W Horn
(74) *Attorney, Agent, or Firm* — Ryan A. Schneider, Esq.; Troutman Sanders LLP

(57) ABSTRACT

A musical instrument such as a trombone is manufactured by moulding from polymeric material. The instrument has a moulded body section which has an internal bore through which air is blown by the player. The internal diameter of the bore has a restriction formed thereon so that the diameter of the bore tapers along the section for tuning or tonal adjustment of the instrument.

17 Claims, 8 Drawing Sheets

OTHER PUBLICATIONS

Examination Report dated Dec. 12, 2012 for related EP Application 2422340.

Christan Griego: "What Does a Trombone Leadpipe Do for You?", Getzen Gazette—Blog Archive, Oct. 2, 2006, XP055044257, Internet Retrieved from the Internet: URL:http://www.getzen.com/gazette/2006/10/02/what-does-a-trombone-leadpipe-do-for-you/ [retrieved on Nov. 14, 2012].

* cited by examiner

MUSICAL INSTRUMENTS

CROSS-REFERENCE TO RELATED APPLICATIONS

This application is a US National Stage of International Application No. PCT/GB2010/000782, filed 19 Apr. 2010, which claims the benefit of 0906968.3, filed 23 Apr. 2009, both herein fully incorporated by reference.

FIELD OF THE INVENTION

This invention relates to wind musical instruments in particular, but not exclusively, to instruments such as trombones.

Traditionally such instruments are made from brass or other metals and are therefore expensive to produce.

BRIEF SUMMARY OF THE INVENTION

It is an object of the present invention to provide a wind instrument which is cheaper to manufacture than a traditional metal instrument.

Thus according to the present invention there is provided a wind instrument having a body section which has an internal bore through which air is blow by the player, said body section being formed from polymeric material, the internal diameter of the bore having a restriction formed thereon so that the diameter of the bore tapers along the section for tuning or tonal adjustment of the instrument.

In such an instrument the wall thickness of the section of the instrument may also vary along the section.

The body section may be formed by a moulding process.

The body section may be formed by winding uncured reinforced polymeric material around a multi-part double tapering mandrel and then curing the material.

The section may be, for example, a leadpipe of a trombone slide.

The instrument may be a trombone having a bell portion including a separate tuning slide, inner and outer main slide portions and a mouthpiece, the outer main slide portion having a first slide brace which is gripped to slide the outer main slide portion to play the instrument and an end section which interconnects two outer slide tubes and which includes a spit/water valve, the inner slide portion having a non-slidable second slide brace which supports the ends of the two inner tubes of the main slide and also supports the mouthpiece, one or more of the bell portion, tuning slide, first and second slide braces and outer slide end portion being manufactured from polymeric material by a moulding process.

The bell, tuning slide, first and second slide braces and outer slide end section may be manufactured in several parts by injection moulding.

The tuning slide may have a balance weight held between its moulded parts. This enables the tuning and tonal response of the instrument to be optimised.

The second slide brace is provided with a female attachment sleeve for receiving a tubular male attachment sleeve mounted on an end of the bell portion on which the main slide is mounted.

The mouthpiece may be received in a leadpipe section of the first inner tube whose internal bore includes the restriction, the leadpipe section being formed as an integral portion of the first inner tube using a mandrel moulding process as described above.

The free ends of the inner tubes of the main slide are fitted with brass sleeves which constitute the main sliding contact with the inner surface of the outer tubes of the slide.

The entry section of the bell portion leading to the tuning slide may have a moulded wall thickness which varies along the length of the entry section to vary the diameter of the bore of this section for tuning or tonal adjustment of the instrument.

The end section of the outer main slide is of a squared-off configuration with two definite bends joined by a general straight centre part.

The generally straight centre part may have an internal bore which varies in diameter along the centre part.

At least one of the inner and outer tubes of the main slide may be of a parallel sided glass/fibre and/or carbon fibre reinforced polymeric construction.

The mouthpiece may also be manufactured from polymeric material by injection moulding.

The bell portion may be provided with an electronic sound sensor for connection to an amplifier, computer or other electronic device.

The sound sensor may be moulded into the bell portion.

One or more masses may be moulded into the parts of the instrument to adjust its tuning or tonal qualities.

The invention also provides a trombone having a bell portion including a separate tuning slide, inner and outer main slide portions and a mouthpiece, the outer main slide portion having a first slide brace which is gripped to slide the outer main slide portion to play the instrument and an end section which interconnects two outer slide tubes and which includes a spit/water valve, the inner slide portion having a non-slidable second slide brace which supports the ends of the two inner tubes of the main slide and also supports the mouthpiece, one or more of the bell portion, tuning slide, first and second slide braces and outer slide end portion being manufactured from polymeric material by a moulding process.

The invention further provides a method of manufacturing the above trombone comprising the steps of:— moulding one or more of the bell portion, separate tuning slide, first and second slide braces, and outer main slide end section by injecting polymeric material into appropriate moulds, removing the moulded parts of the bell portion, tuning slide portion, and first and second slide braces from their moulds and gluing or otherwise securing these parts together to complete these components, providing inner and outer main slide tubes in plastics material, assembling the outer main slide tubes into the first moveable slide brace and end section to complete the outer main slide portion, assembling the inner main slide tubes into the second slide brace to complete the inner main slide portion, and providing a mouthpiece to complete the instrument.

The invention also provides a trombone as described above in which the internal bores of at least one of the bell portion, tuning slide and an end portion of the outer main slide portion are tapering.

The invention further provides a trombone slide leadpipe moulded from polymeric material and having an internal bore with a restriction formed thereon so that the diameter of the bore tapers along the length of the leadpipe.

The invention also provides a trombone slide tuning brace having two end portions which encircle respective outer slide tubes of a trombone and are joined by a connecting brace portion, the tuning brace damping vibrations within the slide tubes to improve the tuning/tonal quality of the trombone.

This tuning brace may be removably mounted on the trombone slide by the player or, where the slide is made from polymeric material, glued or otherwise attached to the slide.

BRIEF DESCRIPTION OF THE DRAWINGS

One embodiment of the present invention will now be described, by way of example only, with reference to the accompanying drawings in which:—

DETAILED DESCRIPTION OF PREFERRED EMBODIMENTS

Figure 1:
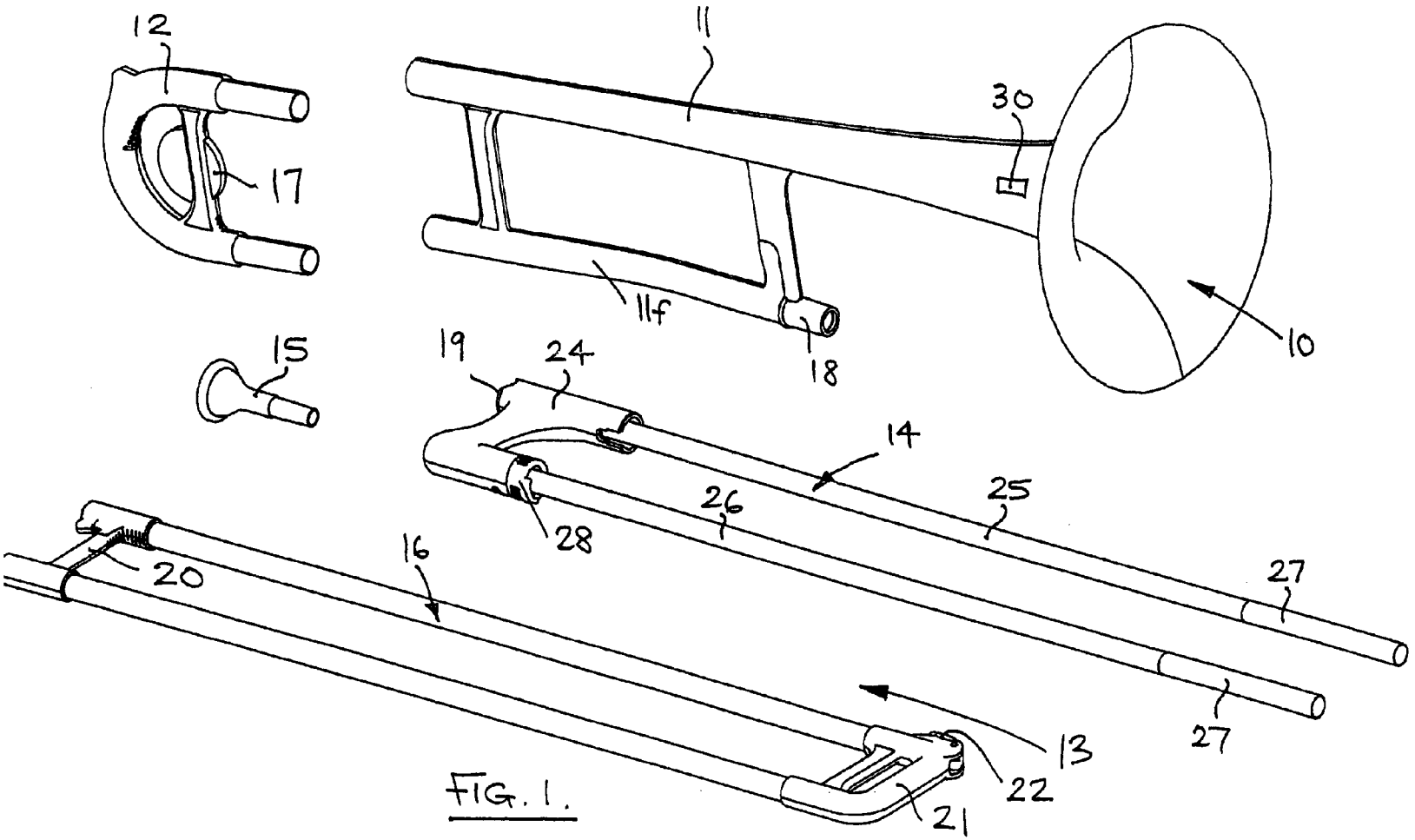
FIG. 1 shows a perspective view of the various portions of an instrument in accordance with the present invention.

Referring to the drawings, FIG. 1 shows in disassembled form the various portions of a trombone 10 in accordance with the present invention. The trombone has a bell portion 11 which includes a separate tuning slide 12 and a main slide 13 which has an inner slide portion 14 which supports a mouthpiece 15 and an outer slide portion 16.

Figure 2:
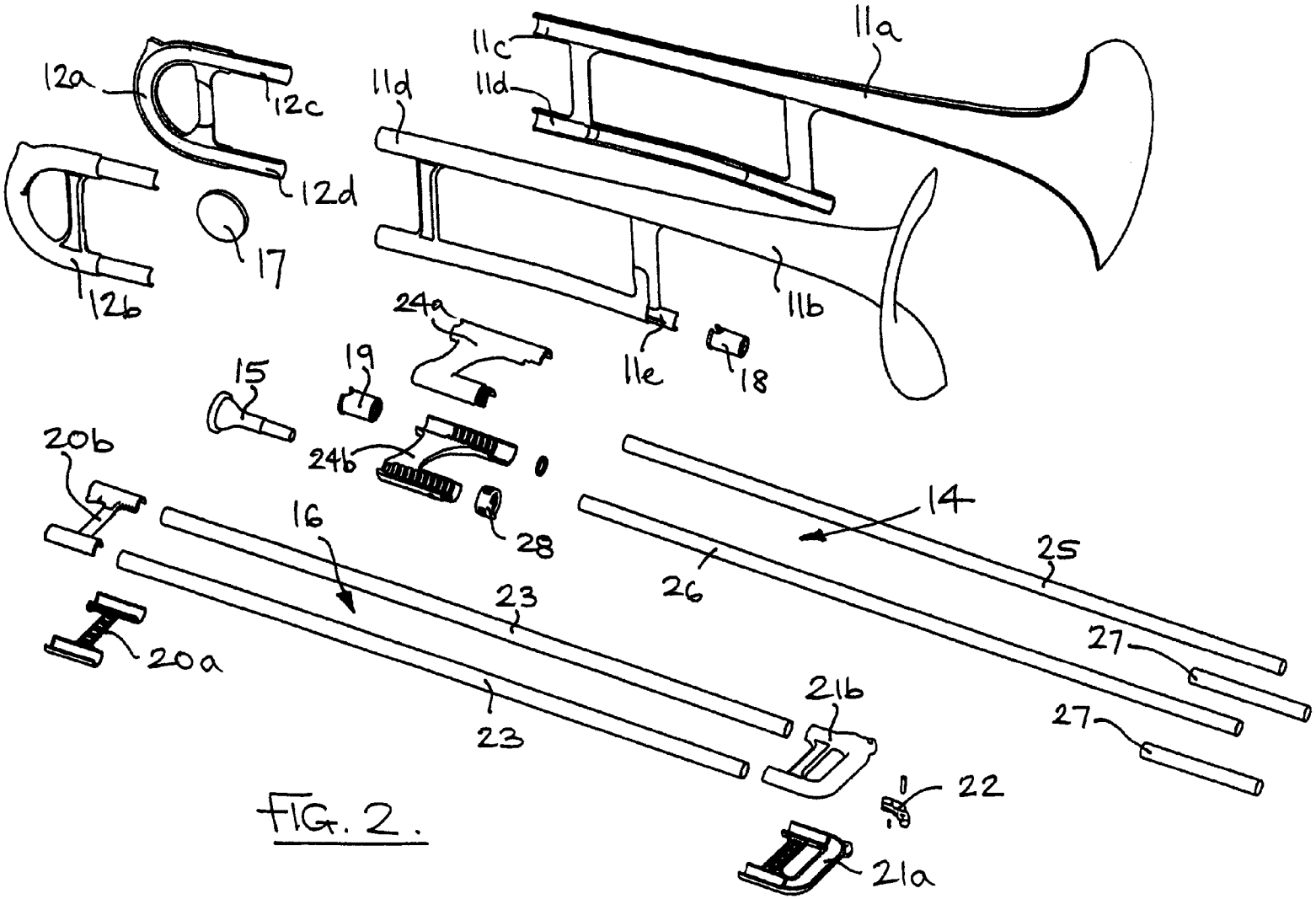
FIG. 2 shows an exploded view of the portions of the instrument shown in FIG. 1.

In accordance with one aspect of the present invention and, as can be seen from FIG. 2, the main bell portion 11 is moulded in two parts 11*a* and 11*b* from polymeric material such as Acrylonitrile Butadiene Styrene (ABS) which may be glass fibre reinforced or Polycarbonate material preferably by injection moulding. Other polymeric materials such as High Impact Polystyrene (HIPS) may also be used. Similarly, the tuning slide 12 is formed in two parts 12*a* and 12*b* again from the same polymeric material and preferably includes a counter weight 17 which is sandwiched between the parts 12*a* and 12*b*. The counter weight also damps vibrating and thus improves the tuning and toned response of the instrument. As is conventional, the tuning slide has reduced diameter and portions 12*c* and 12*d* which can be slid within the ends 11*c* and 11*d* of the main bell portion to tune the instrument.

The end portion 11*e* of the bell 11 is of reduced diameter and carries a tubular tapering male attachment sleeve 18 which reinforces the end of the bell portion. This tubular male sleeve 18 is received in a female attachment tapering sleeve 19 mounted in a recess 19*a* in the main slide 13 as described below.

The use of the inter-engaging tapering male and female sleeves 18 and 19 significantly reinforces the interface between the main slide and the bell portion of the instrument. These sleeves may be constructed from glass fibre or other reinforced polymeric material if required. A lock to lock the inner slide 14 on to the bell portion 11 may also be provided.

The outer slide portion 16 of the main slide 13 has a first slide brace or grip 20 which the player of the instrument grips to move the slide and an end portion 21 which includes a spit or water valve 22.

In accordance with the present invention the first slide brace 20 is again moulded from polymeric material using injection moulding as two parts 20*a* and 20*b*. Similarly the end portion 21 is moulded in two parts 21*a* and 21*b* and the spit valve 22 is also produced by injection moulding. The outer slide is completed by two outer slide tubes 23 which can conveniently be formed by fibre (e.g. glass or carbon) or other reinforced tubular polymeric material which is readily available.

The inner slide 14 includes a second slide brace or handle 24 which receives the female attachment sleeve 19 and is connected with the male tubular sleeve 18 carried on the end portion 11*e* of the bell 11. The second slide brace 24 also receives inner slide tubes 25 and 26 which are inserted in bores defined by ribs 24*c* and 24*d*. Mouthpiece 15 is supported in a leadpipe end portion 26*a* of tube 26 within slide brace 24. By suitable design of the shape of handle 24 the instrument can be made more ergonomic and comfortable for the player to support.

Tubes 25 and 26 carry on their free ends carry brass sleeves 27 which have a slightly larger diameter than the remainder of the tubes 25 and 26 and thus form the main sliding contact with the inner surface of the outer slide tubes 23. It has also been found that the use of brass sleeves 27 helps to combat bacterial odours caused by the player's spit during playing of the instrument.

As can be seen from FIG. 2, the second slide brace 24 is formed in two parts 24*a* and 24*b* and a rotary locking member 28 surrounds the inner tube 25 and is used to lock the outer slide 16 to the second slide brace 24 when the instrument is not being played. A rubber or felt main slide bump stop 31 is housed within slide brace 24 around tube 25 to cushion any contact between this slide braces 20 and 24 when the instrument is played As will be appreciated, the two parts 24*a* and 24*b* of the second slide brace 24 are again formed by injection moulding from polymeric material in accordance with the present invention.

Figure 4:
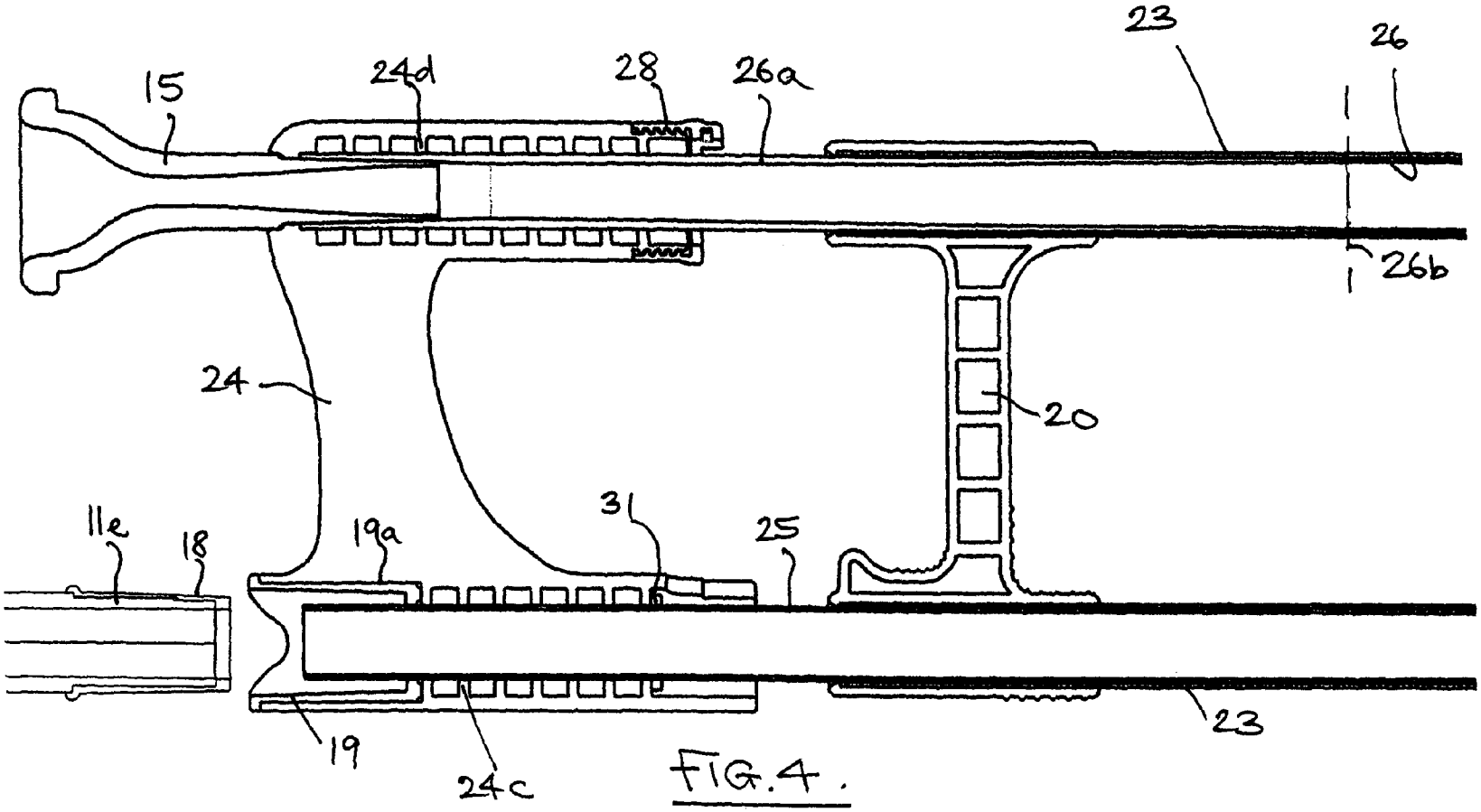
FIG. 4 shows a sectional view on a larger scale of a first and second slide brace of the instrument showing the mouthpiece support and of the attachment to the bell section.
Figure 5:
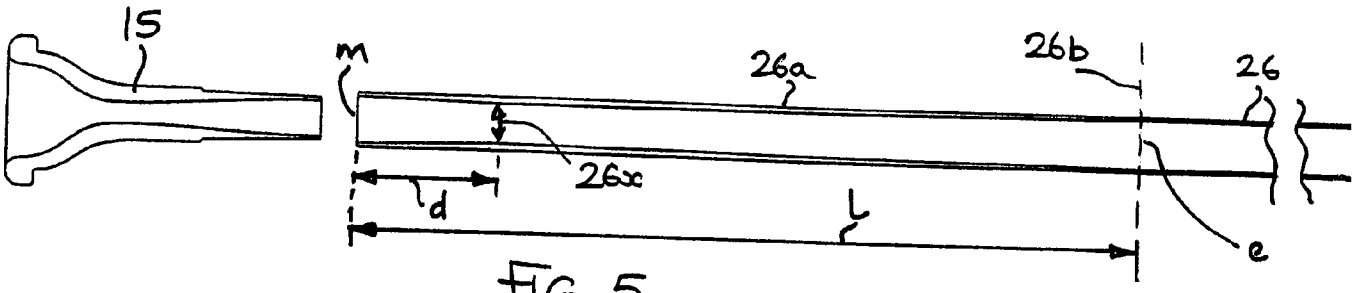
FIG. 5 shows a cross-sectional view of part of an inner slide tube which includes an integral leadpipe with an associated mouthpiece.
Figure 6:
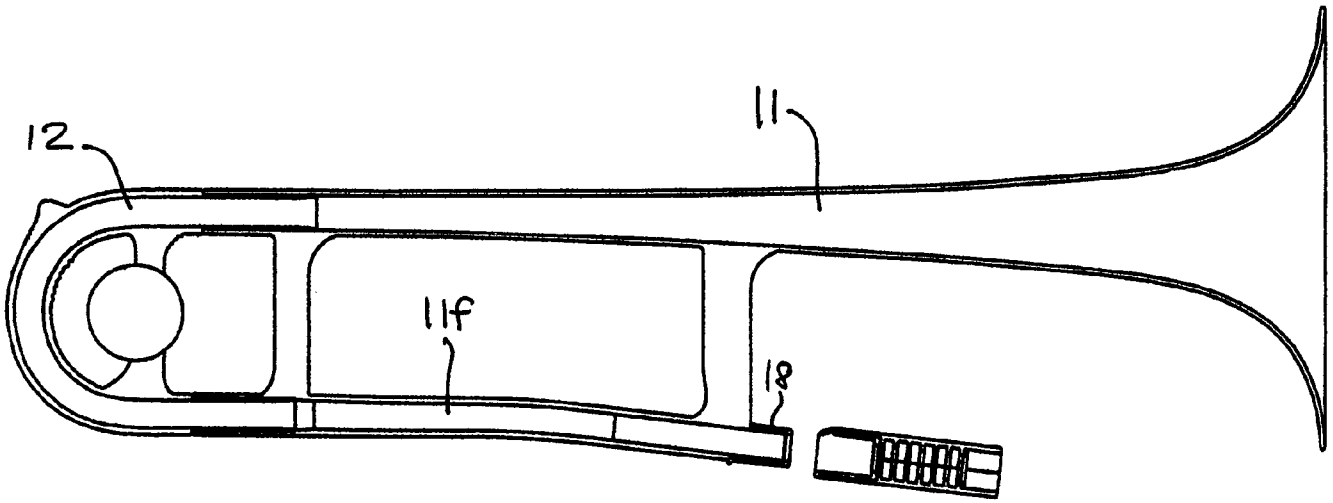
FIG. 6 shows on a larger scale part of the bell portion of the instrument with the tuning slide in position.

As previously described, mouthpiece 15 is supported within the leadpipe 26*a* (to the left of the dotted line 26*b* in FIGS. 4 and 5). The leadpipe 26*a* may be conveniently formed as an integral part of inner slide tube 26 by a moulding process which involves winding uncured reinforced polymeric material (for example, carbon fibres in tape form impregnated with epoxy resin) around a multi-part double tapering mandrel and then curing the material to provide both the leadpipe 26*a* with its integral double tapering bore and the remainder of tube 26. Glass fibres, carbon fibres or Kevlar fibres are examples of suitable reinforcing materials for this method of manufacture.

Because the leadpipe is produced by the above moulding process it can be produced cheaply and economically with the required restricted cross-section 26*x* to produce the correct tuning and tonal quality of the instrument. Typically restriction 26*x* is located a distance 'd' of 36.30 mm from the end of leadpipe 26*a* in a leadpipe of a length 'l' of say 200 mm. The internal diameter of the slide tube 26 will begin at say 12.10 mm at the mouth piece end "m", reduce to say 8.30 mm at restriction 26*x* and then taper to 12.67 mm at the end "e" of leadpipe 26*a*. For the remainder of the tube 26 to the right of line 26*b* the bore is parallel at 12.67 mm. There may be a slight taper at the extreme right hand end of tube 26 to reduce the step change between the inner diameters of the inner and outer slide tubes.

If desired, the leadpipe could be manufactured from traditional metal material and simply detachably housed within the inner slide tube 26.

Alternatively it may be possible to produce the entire tube 26 including the leadpipe 26*a* by injection moulding from polymeric material such as the ABS, HIPS or Polycarbonate materials referred to above.

The remaining inner slide tube 25 can be again provided from relatively cheap glass fibre or other reinforced plastics tubing which is readily available.

The mouthpiece 15 can again be produced from polymeric material by an injection moulding process in which the final required dimensions of the mouthpiece are defined by the mould. Alternatively the mouthpiece could be manufactured by a turning operation from a solid polymeric blank although this is of course a more expensive process.

Again, if required, a metal mouthpiece could be used and a composite instrument with a metal bell portion 11 may also be provided.

Figure 3:
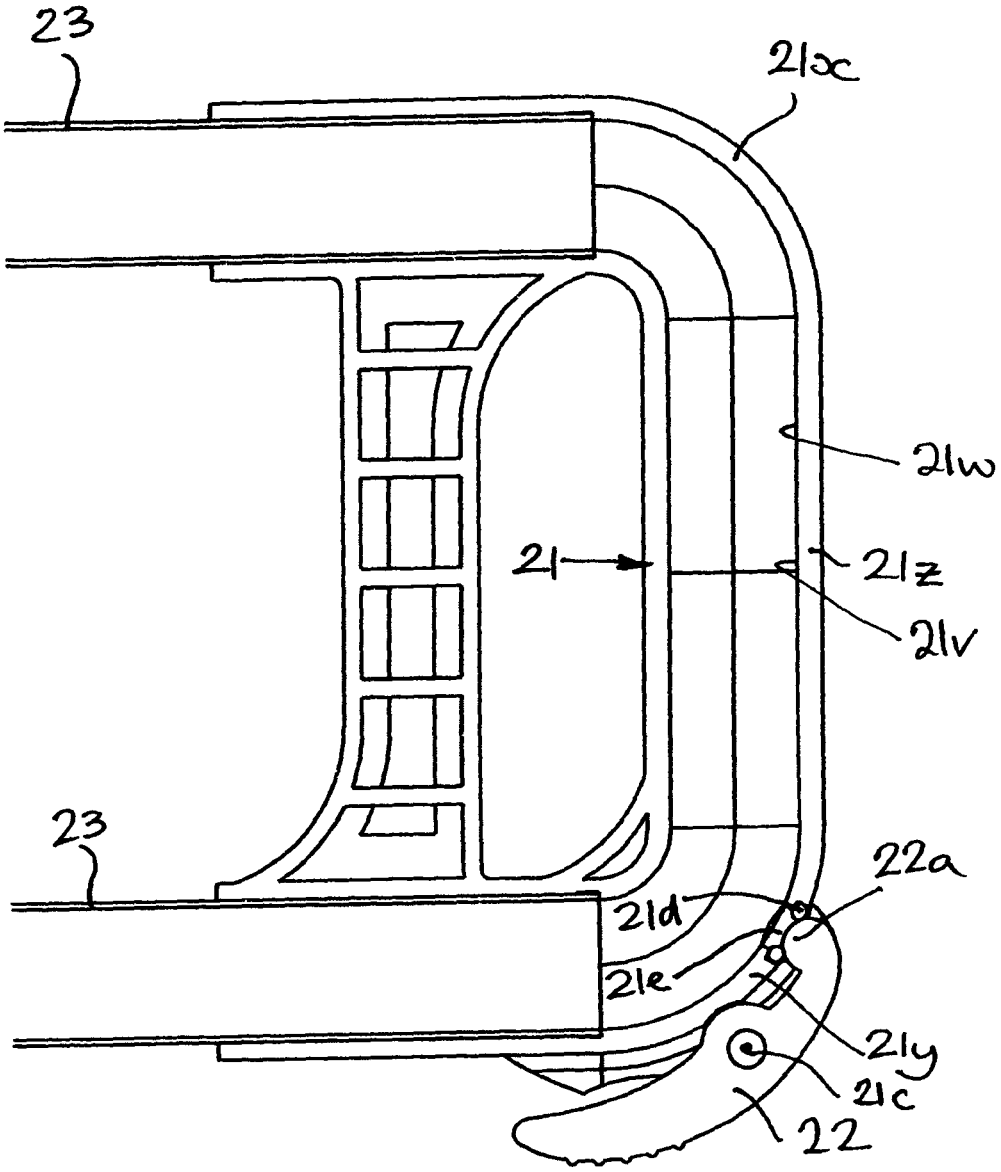
FIG. 3 shows a view on a larger scale of an end section of the main slide of the instrument.

FIG. 3 shows another feature of the present invention namely the shape of the end section 21 of the trombone. Due to the difference in the feel when blown of a plastic instrument compared to a traditional metal instrument, it has been found that a better feel can be given to the instrument if the end section is provided with two definite curves 21*x* and 21*y* joined by a straight centre section 21*z*. This squared-off end section shape affects the flow of air through the instrument and produces a plastic instrument which has a similar feel when blown to the traditional metal instrument. Additionally the bore 21*w* of centre section 21*z* may be of a double tapering form with a central restriction such that the internal diameter of the central zone 21*v* of the bore may be say 1 mm smaller in diameter than the outer zones of bore 21*w*.

The spit/water valve member 22, which is again injection moulded from polymeric material, is pivoted on the end section 21 about an axis 21*c* and has a sealing portion 22*a* which contacts an O-ring type sealing member 21*d* mounted in the spit hole 21*e* of the end section 21.

The above description describes the various component parts of the instrument and in particular the fact that the bell section 11, tuning slide 12, first moveable slide brave 20, end section 21 and second slide brace 24 are all moulded from polymeric material by an injection moulding process. Alternatively, blow moulding or vacuum forming processes may be used.

As will be appreciated, after the parts of these portions of the instrument are removed from their respective injection moulds, the parts of the instrument, as shown in FIG. 2 are glued or otherwise secured together to complete the bell portion, tuning slide, first slide brace 20, end portion 21 and second slide brace 24. The inner tubes 25 and 26 are then glued into the second slide brace 24 and the outer tubes 23 are glued into the first slide brace 20 and the end section 21. The brass sleeves 27 are then secured to the inner tubes 25 and 26 and the male and female attachment sleeves 18 and 19 are secured to the bell end portion 11*e* and also to the second slide brace 24 respectively.

It will be appreciated, the above trombone construction provides an instrument which is significantly cheaper to manufacture than the traditional metal instrument and which is still capable of producing a sound comparable with that of the traditional metal instrument. The instrument can also be produced in a variety of colours, is lighter in weight and more durable and robust as it cannot be dented like a conventional metal instrument One or more masses may be moulded into parts of the instrument to adjust its tuning or tonal qualities. These masses may be separate metal or other components which are moulded into the instrument or may be provided by locally increasing the wall thickness of the instrument when it is moulded.

The bell portion 11 may be provided with a sound sensor 30 which may be simply stuck to the exterior of the bell portion or moulded into the bell portion during the manufacture of one of the parts of the bell. This sound sensor may be connected to an amplifier, computer or any other electronic device to act as a tuning aid or to significantly extend the capabilities of the instrument so that the instrument can be used to mimic other instruments such as guitars, saxophone etc using appropriate software packages. This facility not only assists learners in establishing the exact position of each note on the slide using a tuned package which indicates the correct note by green light etc but also enables advanced players to get considerably enhanced satisfaction from their instrument by adjusting its sound output in a wide variety of ways.

The tube 11*f* of the bell portion 11 may be provided with a section whose cross sectional bore varies along the length of the section to change the tuning and/or tonal qualities of the instrument relatively cheaply.

Because the instrument is moulded from plastics material it is relatively easy to produce a section of the instrument which has a wall thickness which varies along that section of the instrument to provide a varying diameter of the bore in that section which, as indicated above enables precise adjustment of the tuning or tonal qualities of the instrument.

Also, as all the parts of the instrument are produced by injection moulding, it is easier to approach the ultimate goal of having a trombone in which there is a substantially continuous increase in bore diameter after the lead pipe restriction 26*x*. Thus the internal bore of the slide tube 26, the end section 21, the tube 25, the tube 11*f*, the tuning slide 12 and the bell 11 may all be moulded to have a tapering increase in diameter. Even if a continuously tapering internal bore is not employed in tubes 25 and 26 an improvement in performance can be achieved if, for example, the internal bore of the last few centimeters of tubes 25 and 26 which enter the outer slide portion 16 are tapered to avoid a significant step change in bore diameter between tubes 25 and 26 and the outer slide 16.

Similarly, even if all the internal bore of tuning slide 12 is not tapered a useful improvement in performance can be achieved if the internal diameters of the end portions of slide 12 which enter bell 11 are tapered to avoid significant step changes in bore diameter.

Figure 7:
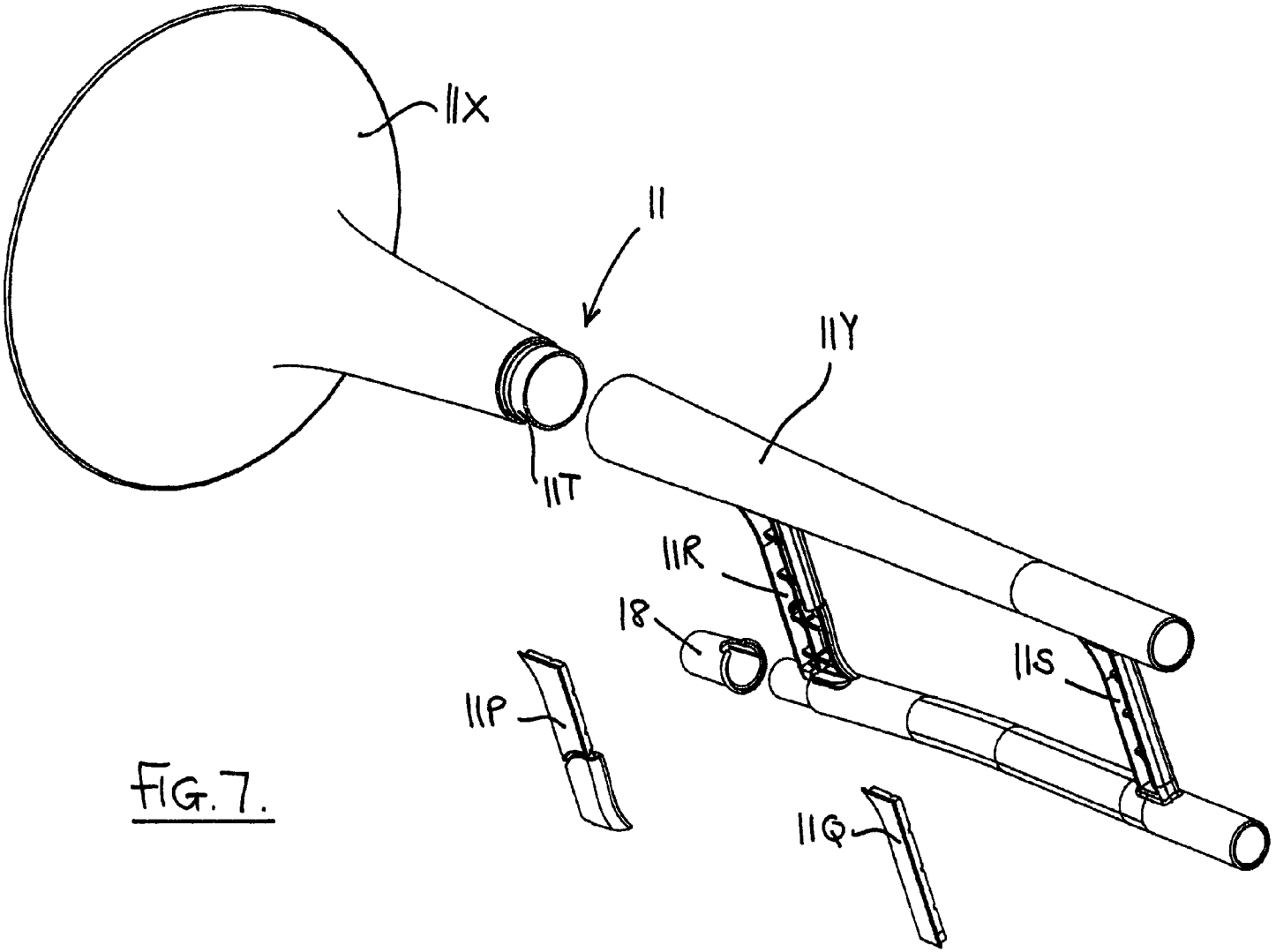
FIG. 7 shows an alternative trombone bell construction.

Various alternative constructions can be employed to produce the trombone described above. For example, as shown in FIG. 7, the bell section 11 may have an outer portion 11*x* formed as a single piece injection moulding and a main body portion 11Y formed as a second single piece injection moulding with capping strips 11P and 11Q which cover integrally moulded cross braces 11R and 11S respectively. The bell is again provided with attachment sleeve 18. The outer bell portion 11*x* has a reduced diameter portion 11T which is inserted into and glued in the main body portion 11Y.

Figure 8:
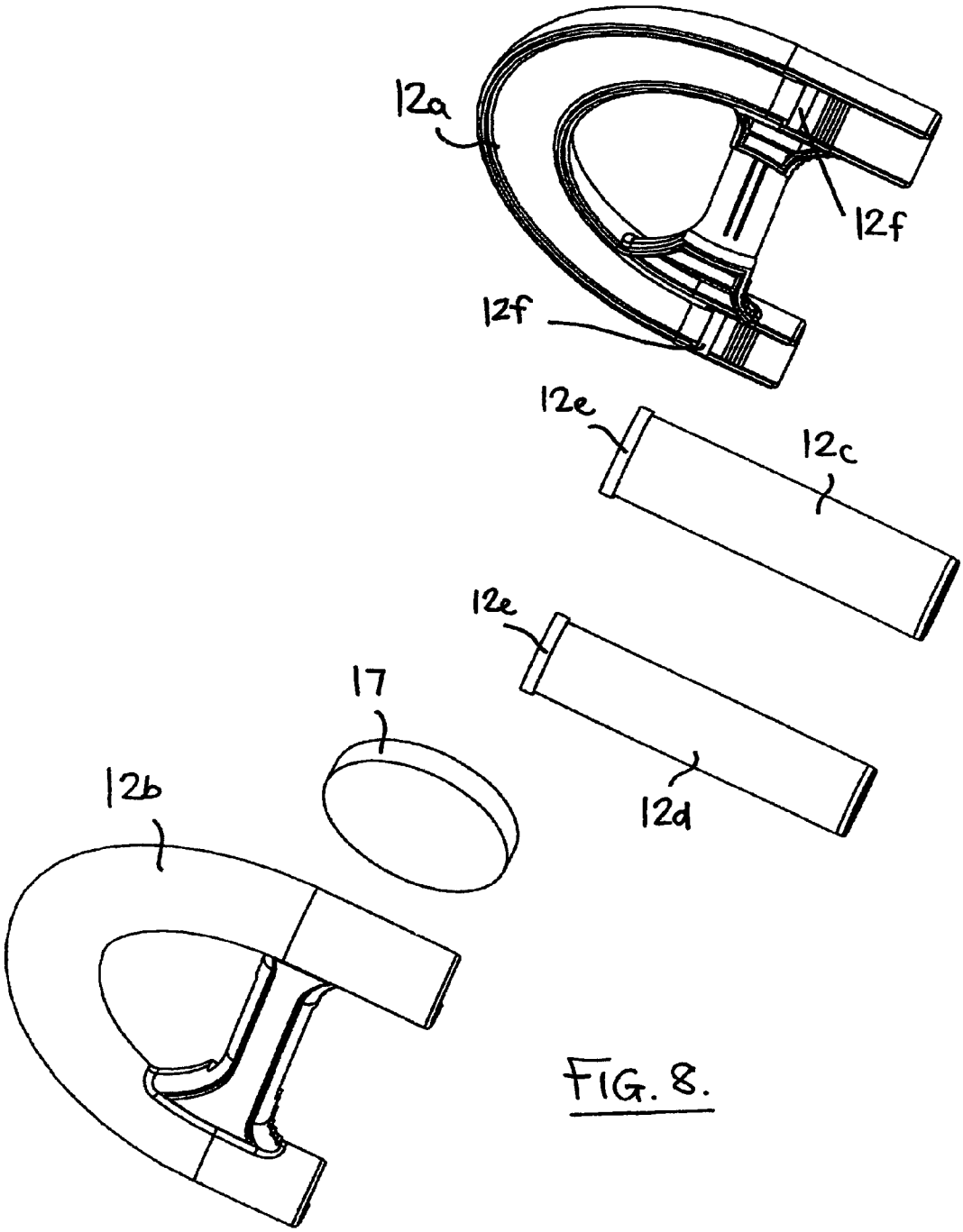
FIG. 8 shows an alternative trombone tuning slide construction.

Also, for example, tuning slide 12 may be formed by injection moulding from four separate parts 12*a*, 12*b*, 12*c* and 12*d* plus the counter weight 17 as shown in FIG. 8. The end portions 12*c* and 12*d* of the tuning slide have flanges 12*e* which are located in grooves 12*f* in portions 12*a* and 12*b* to assist in locating portions 12*c* and 12*d* when they are glued into portions 12*a* and 12*b*. By forming the tuning slide in four portions 12*a*, 12*b*, 12*c* and 12*d* not only is manufacturing generally simplified but it is easier to taper the internal bores of these portions as discussed above.

This principle of moulding a variable wall thickness and bore cross-section into a section of a wind instrument is also usable in instruments other than trombones, for example, any conventional brass instrument such as a trumpet, French horn or cornet.

The technique of producing a section of a wind instrument by wrapping material around a multi-part mandrel can be extended to other parts of a trombone and to parts of other wind instruments. Glass fibres, carbon fibres or Kevlar fibres are examples of suitable reinforcing materials for this method of manufacture.

Figure 9:
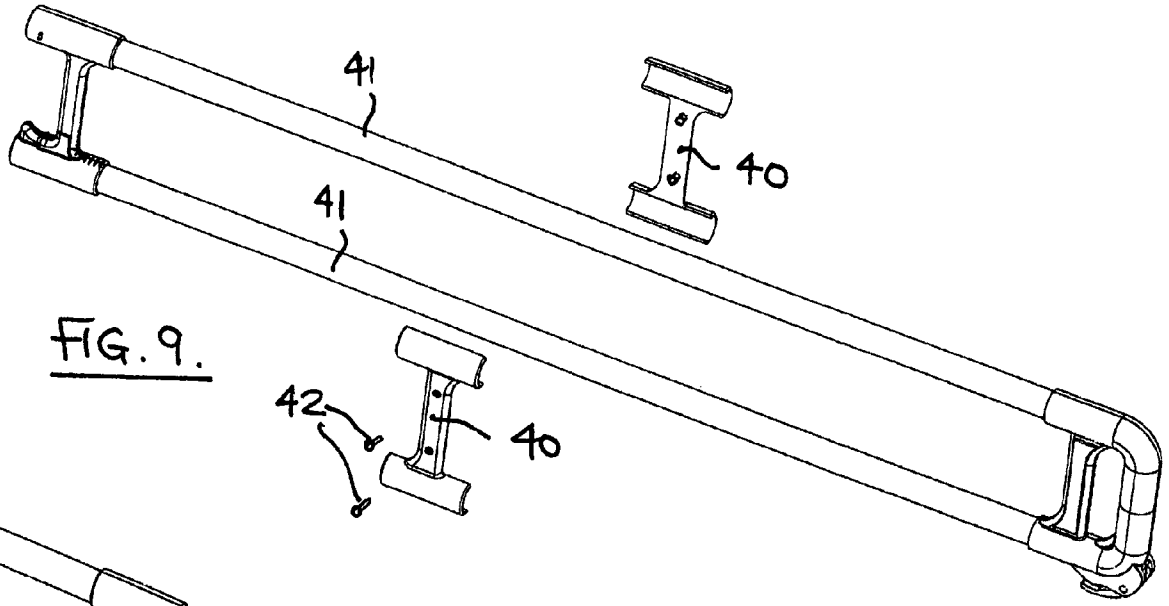
FIGS. 9 and 10 show details of a trombone slide tuning brace.
Figure 10:
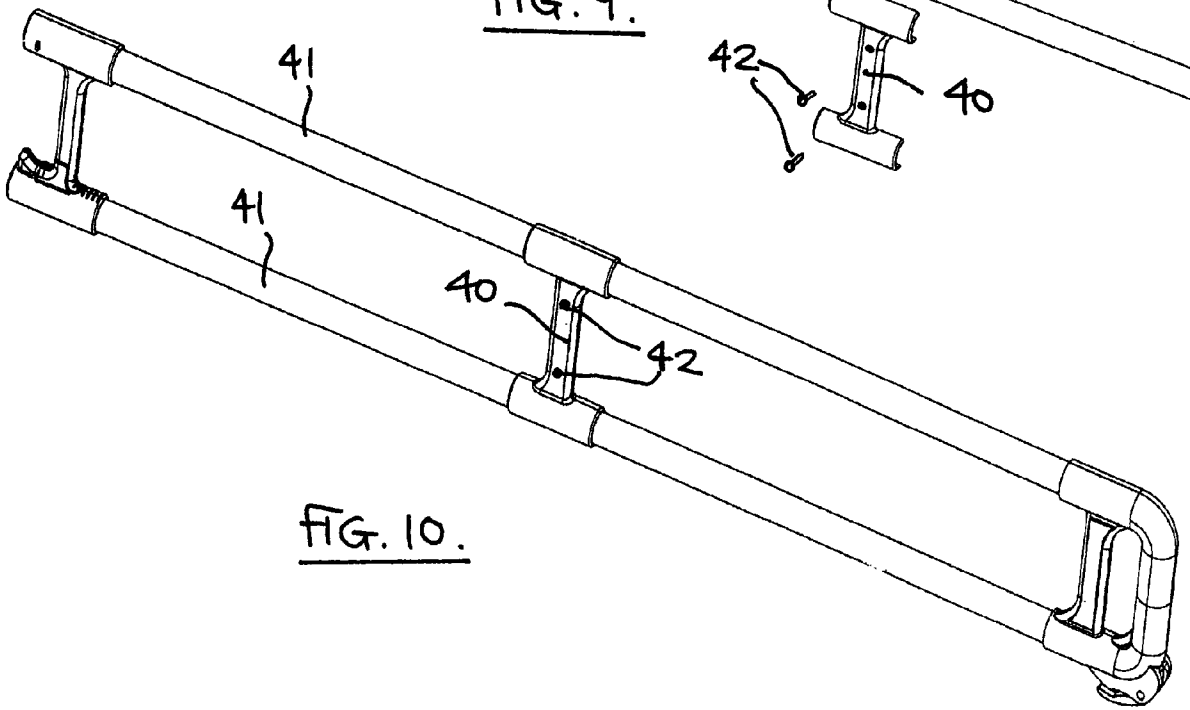

The invention also provides a further feature namely the tuning brace 40 shown in FIGS. 9 and 10. This brace is a two piece injection moulding of polymeric material which can be secured together by screws 42, as shown in FIG. 10, to tightly embrace the outer slide tubes 41 of a trombone slide (whether the slide is made from metal or plastics material). This reinforces the overall structure of the slide and thus applies a damping effect to improve the tuning and tonal response of the instrument. The brace must not grip the slide tubes too tightly otherwise they may be compressed and damaged thus affecting the sliding of the instrument. The brace 40 is designed to be located substantially in the central region of the tubes 41 with the instrument player varying the position of the brace to adjust the tuning/tone of the instrument. If the slide is made from plastics material the tuning brace may be glued or otherwise permanently secured to the slide.

The invention claimed is:

1. A musical instrument of the brass instrument family comprising a tube section having a leadpipe integrally molded therewith, the tube section and the leadpipe being molded as a single piece component comprising polymeric material, the wall thickness of the single piece component varying along its length to provide a tapering internal bore that reduces in cross section towards a restriction and increases in cross section away from the restriction for tuning or tonal adjustment of the instrument.

2. The instrument of claim 1, wherein the integrally molded leadpipe and tube section comprise a trombone slide inner tube.

3. The instrument of claim 1, wherein the integrally molded leadpipe and tube section are formed by winding uncured reinforced polymeric material around a multi-part double tapering mandrel and curing the material.

4. The instrument of claim 1 further comprising a bell portion provided with an electronic sound sensor molded into the bell portion for connection to an electronic device.

5. The instrument of claim 1, wherein one or more masses are molded into the parts of the instrument to adjust its tuning or tonal qualities.

6. The instrument of claim 1 in the form of a trombone having a bell portion including a separate tuning slide, inner and outer main slide portions and a mouthpiece, the outer main slide portion having a first slide brace that is gripped to slide the outer main slide portion to play the instrument and an end section that interconnects two outer slide tubes and that includes a spit/water valve, the inner slide portion having a non-slidable second slide brace that supports the ends of the two inner tubes of the main slide and also supports the mouthpiece, one or more of the bell portion, tuning slide, first and second slide braces and outer slide end portion being manufactured in several parts from polymeric material by an injection molding process.

7. The instrument of claim 6, wherein the tuning slide has a balance weight held between its molded parts.

8. The instrument of claim 6, wherein the second slide brace is provided with a female attachment sleeve for receiving a tubular male attachment sleeve mounted on an end of the bell portion on which the main slide is mounted.

9. The instrument of claim 6, wherein the free ends of the inner tubes of the main slide are fitted with brass sleeves that constitute the main sliding contact with the inner surface of the outer tubes of the slide.

10. The instrument of claim 6, wherein the entry section of the bell portion leading to the tuning slide has a molded wall thickness that varies along the length of the entry section to vary the diameter of the bore of this section for tuning or tonal adjustment of the instrument.

11. The instrument of claim 6, wherein the end section of the main slide is of a squared-off configuration with two definite bends joined by a general straight center part.

12. The instrument of claim 11, wherein the generally straight center part has an internal bore that varies in diameter along the center part.

13. The instrument of claim 6, wherein the outer slide tubes carry in addition to the first slide brace a tuning brace having two end portions that encircle respective outer slide tubes and are joined by a connecting brace portion, the tuning brace damping vibrations within the slide tubes to improve the tuning/tonal quality of the trombone.

14. The instrument of claim 6, wherein the bore of at least one of the inner slide tubes is also tapering.

15. A trombone slide tuning brace for fitment between a first slide brace at one end of the slide that is gripped to slide the slide and an end section of the slide which connects outer slide tubes of the slide, the tuning brace comprising two end portions that encircle respective outer slide tubes of a trombone and are joined by a tuning brace, the tuning brace damping vibrations within the slide tubes to improve the tuning/tonal quality of the trombone.

16. The tuning brace of claim 15 molded from polymeric material.

17. A brass instrument comprising a bell portion molded from polymeric material, the bell portion provided with an electronic sound sensor molded into the bell portion for connection to an electronic device.

* * * * *